United States Patent [19]

Abbott et al.

[11] 4,428,702

[45] * Jan. 31, 1984

[54] SLIDING TENSION LEG TOWER WITH PILE BASE

[75] Inventors: Barry J. Abbott, Concord; William H. Silcox, San Francisco, both of Calif.

[73] Assignee: Chevron Research Company, San Francisco, Calif.

[ * ] Notice: The portion of the term of this patent subsequent to Dec. 27, 2000 has been disclaimed.

[21] Appl. No.: 275,541

[22] Filed: Jun. 19, 1981

[51] Int. Cl.[3] ..... E02B 17/00

[52] U.S. Cl. ..... 405/202; 405/227

[58] Field of Search ..... 405/195, 196, 200, 202, 405/203, 224, 227; 114/264, 265; 175/7

[56] References Cited

U.S. PATENT DOCUMENTS

| | | | |
|---|---|---|---|
| 987,266 | 3/1911 | Smith | 405/196 X |
| 3,294,051 | 12/1966 | Khelstovsky | 405/200 X |
| 3,347,053 | 10/1967 | Manning | 405/227 X |
| 3,533,241 | 10/1970 | Bowererman et al. | 405/227 X |
| 4,127,005 | 11/1978 | Osborne | 405/227 |
| 4,135,841 | 1/1979 | Watkins | 405/196 |
| 4,320,993 | 3/1982 | Hunter | 405/224 |

FOREIGN PATENT DOCUMENTS

| | | | |
|---|---|---|---|
| 473849 | 12/1973 | Australia | 405/227 |
| 2646134 | 4/1978 | Fed. Rep. of Germany | 405/202 |

*Primary Examiner*—David H. Corbin

*Attorney, Agent, or Firm*—D. A. Newell; E. J. Keeling; R. H. Evans

[57] ABSTRACT

A compliant offshore drilling and producing structure is disclosed. Axial piles extend from articulated joints on a pile base at the sea floor to above the water's surface and are enveloped by sleeves extending downwardly from a rigid platform. Buoyant chambers attached to the sleeves support most of the platform weight and provide righting stability. The platform weight is supported by the axial piles through hydraulic means.

7 Claims, 1 Drawing Figure

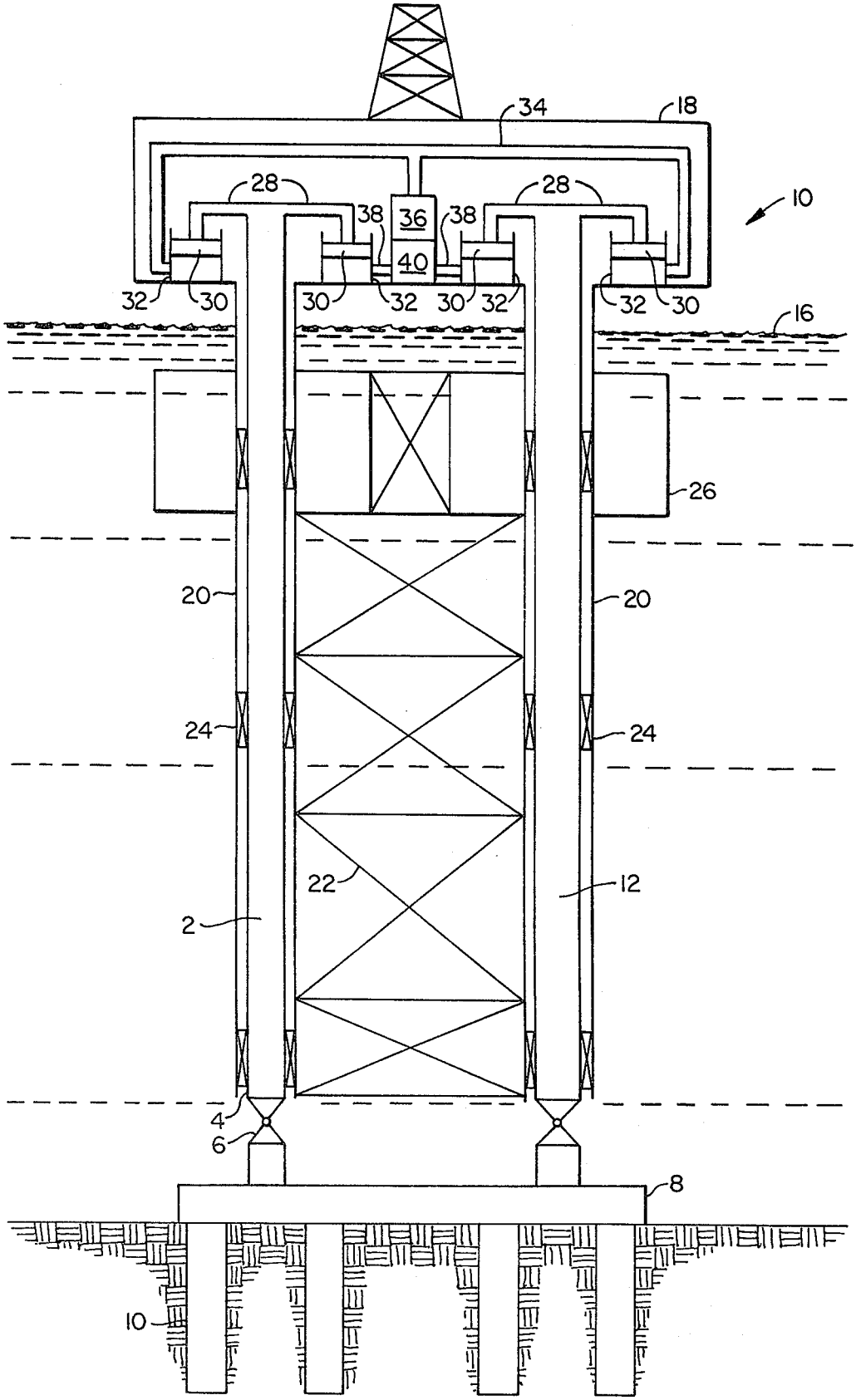
34
18
28
28
10
38
36
38
40
32
30
30
32
30
32
32
30
16
26
20
20
24
24
22
12
2
4
6
8
10

SLIDING TENSION LEG TOWER WITH PILE BASE

RELATED APPLICATIONS

This application is related to applications Ser. No. 235,194, Ser. No. 235,274, Ser. No. 275,542; filed on Feb. 17, 1981, Feb. 17, 1981 and June 19, 1981, respectively; all by Barry J. Abbott and William H. Silcox.

FIELD OF THE INVENTION

This invention relates to offshore structures for drilling and producing operations. In particular the invention is concerned with a compliant structure suitable for use in water depths in excess of 1,000 feet.

PRIOR ART

The use of offshore structures for drilling and producing operations has become relatively commonplace in recent years. However, as more petroleum fields are being developed in deeper waters, the search continues for structures capable of withstanding the hostile wind and wave forces encountered without being prohibitive in cost.

Two structures proposed in the prior art for operation in water depths greater than 1,000 feet are the guyed tower and the buoyant articulated tower. The guyed tower is a trussed structure that is supported on the ocean floor with a spud can or with pilings. Guy lines run from the deck to fairleads below the water surface to clump weights on the ocean floor. Since the tower will sway a few degrees during the passage of large waves, the well conductors must flex at the tower base. Preferably the fairleads are positioned at about the same elevation as the center of pressure of the applied design wave and wind loads. The environmental forces are therefore, more or less, colinear with the mooring system and the moment transmitted to the tower base is minimized. Beyond the clump weights, the guy lines are attached to suitable fixed anchors. Thus, the clump weights may be lifted from the bottom by heavy storm waves permitting further displacement of the tower.

An articulated buoyant tower differs from the foregoing fixed structure in several important respects. An articulated joint, such as a universal or ball joint, attaches the tower to a pile base thereby permitting the tower to tilt in response to environmental forces. A set of buoyant chambers provides the necessary righting moment and the upward force is effectively negated by a ballast chamber located near the bottom of the tower. The primary objection to such articulated systems arises as a result of the tower's lack of redundancy and the difficulty of inspection and/or replacement of the articulated joint.

A tension leg platform is a buoyant floating structure held in place by vertical tension cables anchored to the sea floor. The flotation chambers are designed to minimize the platform's response to weather and wave conditions.

The present invention combines the better features of the above systems in a new and ingenious manner to produce a superior structure for offshore drilling and producing operations.

SUMMARY OF THE INVENTION

The present invention relates to a compliant offshore drilling and producing structure. In accordance with the invention a plurality of axial load piles are attached by articulated joints to a pile base on the sea floor and extend upwardly therefrom to a point beyond the upper surface of the water. A rigid platform is provided having a plurality of open ended sleeves affixed thereto and extending downwardly therefrom in a substantially vertical orientation over each of the axial piles. Buoyant means affixed to the sleeves below the water line are used to provide a buoyant upward force in excess of the weight of the platform, equipment and sleeves which provides righting stability for the platform. Means are also provided for counterbalancing the buoyant forces in excess of the platform weight from the plurality of axial load piles. Preferably these latter means comprise pistons attached to the ends of the axial piles which extend downwardly into hydraulic cylinders secured to the platform. Means are provided for injecting hydraulic fluid into each of the cylinders and preferably groups of the cylinders are connected to a single hydraulic circuit.

Bearings are provided between the axial piles and the sleeves to facilitate vertical movement of the weight from being applied to the axial piles in the event of a rupture in the chambers.

BRIEF DESCRIPTION OF THE DRAWING

The drawing is a schematic diagram of apparatus suitable for use in the present invention.

DESCRIPTION OF THE PREFERRED EMBODIMENTS

Referring to the drawing there is shown a structure in accordance with the present invention, generally referred to by reference numeral 2. A plurality of axial load piles 4, preferably at least 3 in number, are attached by articulated joints 6 to a pile base 8 secured to the sea floor 14 by foundation piles 10 to provide an adequate resistance against the environmental forces, primarily wind and wave, which may occur. As illustrated, the axial piles 4 extend upwardly from the pile base beyond the water's surface 16. The articulated joints and the pile base are of conventional design.

A platform 18 which provides the necessary working space for the drilling and producing operations and which may also provide housing and office space for the crew is situated above the water line beyond the height of the maximum anticipated storm sea.

A plurality of sleeves 20 are rigidly attached in any conventional manner to the platform 18 and extend vertically downward over each of the axial piles. Preferably, the sleeves will extend below the water line at least 75% and preferably 98% of the distance to the sea floor. The sleeves are also preferably cross braced with stiffening trusses 22 substantially along their underwater lengths.

Bearings 24 are provided between the sleeves 20 and the piles 4 to facilitate relative axial movement therebetween. The bearings may be of any suitable and conventional design to lower the frictional forces which would otherwise develop and provide lateral support to the axial piles. Under the conditions of use, the bearings should preferably be designed as a permanent system which will not require replacement during the life of the structure. Where this is not possible, sufficient access should be provided to the components to the bearing system so that it is possible to replace critical elements with minimum dismantling of adjacent components.

Preferably 101–105% of the weight of the entire structure, including the platform and its associated equipment, and excluding the axial piles, articulated joints and pile base, will be supported by buoyancy chambers 26 conventionally affixed to the sleeves beneath the water line. Buoyancy chambers 26 provide a righting moment to the tower whenever it sways from true vertical orientation due to environmental forces. These chambers should be compartmented so that unexpected sealing failures will not unduly burden the foundation pilings.

Normally two sets of buoyant chambers will be used for the structure's tow and installation at the drilling site. The chambers provided for supporting the lower portion of the sleeves during transportation may be flooded to submerge the structure, removed, or shifted towards the upper end of the unit.

The upper end of each axial pile 4 extends through its associated sleeve as shown in the drawing and is connected by cross arms 28 to pistons 30. Each piston is housed in a hydraulc cylinder 32 affixed to the platform in a load bearing relationship. Preferably at least one cylinder attached to each axial pile is serviced with hydraulic fluid via lines from a single fluid reservoir housed in the platform. As shown in the drawing, line 34 provides a flow path for hydraulic fluid from reservoir 36 to the outer cylinders and line 38 provides a flow path for hydraulic fluid from reservoir 40 to the inner cylinders.

The excess buoyant force over the weight of the platform and sleeves is counterbalanced or resisted by tension in the axial piling through the hydraulic cylinders, fluid and pistons. This system gives the overall structure the desired degree of compliancy of desired degree of compliancy of rotation about the sea floor but resists platform heave or vertical motion.

While use of hydraulic means as set forth above is preferred for coupling the structure sleeves and platform to the axial load piles, it is within the spirit and skill of this invention to use conventional mechanical systems to accomplish the same end.

We claim:

1. An offshore drilling and producing structure, which comprises:

a rigid platform including equipment associated therewith;

a plurality of open-ended sleeves affixed to the platform and extending downwardly therefrom for a substantial distance below a water surface, in a substantially vertical orientation;

an equal plurality of axial piles secured by articulated joints to a pile base on the sea floor, which axial piles extend upwardly into said open-ended sleeves to at least a position near the surface of the water;

buoyant means affixed to said sleeves below the water surface for providing an upward buoyant force in excess of the weight of said platform including equipment associated therewith and said sleeves; and means for counterbalancing the excess buoyant force from the plurality of axial piles, said means permitting simultaneous vertical movement of each of said sleeves with respect to each of said piles to permit a desired degree of compliancy of rotation about the sea floor.

2. An offshore drilling and producing structure as recited in claim 1, further comprising:

bearings situated between said axial piles and said sleeves to facilitate the vertical movement of the sleeves with respect to said piles.

3. An offshore drilling and producing structure as recited in claim 1, wherein at least 101% of the platform and sleeve weight is supported by the buoyant means.

4. An offshore drilling and producing structure as recited in claim 1, wherein at least 3 axial piles are used.

5. An offshore drilling and producing structure as recited in claim 1, wherein the length of the sleeves below the water surface extends at least 75% of the water depth.

6. An offshore and drilling and producing structure as recited in claim 1, wherein said means for counterbalancing the excess buoyant force and for permitting a desired degree of compliancy of rotation about the sea floor includes:

at least one piston secured to the upper end of each of said axial piles in a substantially vertical downwardly facing orientation with respect to the piston axis;

a cylinder for each piston to travel in, said cylinder secured to the platform; and means for injecting hydraulic fluid into said cylinders.

7. An offshore drilling and producing structure as recited in claim 6, wherein all of said cylinders are connected to a single hydraulic circuit.

* * * * *